US008151838B2

(12) United States Patent
Seaborne et al.

(10) Patent No.: US 8,151,838 B2
(45) Date of Patent: Apr. 10, 2012

(54) LIQUID DISPENSING SYSTEM

(76) Inventors: Cameron Seaborne, Durban North (ZA); Gregory Edward Creed, Durban North (ZA)

( * ) Notice: Subject to any disclaimer, the term of this patent is extended or adjusted under 35 U.S.C. 154(b) by 522 days.

(21) Appl. No.: 12/303,739

(22) PCT Filed: Jun. 1, 2007

(86) PCT No.: PCT/IB2007/052066

§ 371 (c)(1),
(2), (4) Date: Mar. 30, 2009

(87) PCT Pub. No.: WO2007/141719

PCT Pub. Date: Dec. 13, 2007

(65) Prior Publication Data

US 2010/0230007 A1 Sep. 16, 2010

(30) Foreign Application Priority Data

Jun. 6, 2006 (ZA) ..... 2006/04626

(51) Int. Cl.
*B65B 1/04* (2006.01)

(52) U.S. Cl. ..... 141/350; 141/356

(58) Field of Classification Search ..... 141/350–356, 141/18, 20, 25, 27, 29, 113
See application file for complete search history.

(56) References Cited

U.S. PATENT DOCUMENTS 3,601,164 A * 8/1971 Bruce ..... 141/20
6,883,564 B2 * 4/2005 Risch et al. ..... 141/113

FOREIGN PATENT DOCUMENTS

GB 2137171 A 10/1984
WO 2005/058745 A2 6/2005
WO 2007/102139 A1 9/2007

* cited by examiner

*Primary Examiner* — Davis Hwu
(74) *Attorney, Agent, or Firm* — Grossman Tucker Perreault & Pfleger PLLC

(57) ABSTRACT

The invention relates to a liquid dispensing system. The system includes a liquid dispensing apparatus (10, 50) having liquid dispensing nozzles (18) and containers (12, 52) that each have a one-way valve (30, 70) located in a charging opening defined in the base region thereof. A container is positionable on the apparatus with a dispensing nozzle penetrating the container via the charging opening and the one-way valve thereof, providing for bottom filling of the container and sealing of the charging opening by the one-way valve when the dispensing nozzle is retracted from the container.

11 Claims, 9 Drawing Sheets

LIQUID DISPENSING SYSTEM

TECHNICAL FIELD

THIS INVENTION relates to a liquid dispensing system. The invention relates particularly to a liquid dispensing system that provides for dispensing of a liquid such as a carbonated beverage, beer, and the like, and that includes a liquid dispensing apparatus and containers for use with the apparatus and into which a liquid can be dispensed by the apparatus.

BRIEF SUMMARY OF THE INVENTION

According to the invention there is provided a liquid dispensing system, which includes a liquid dispensing apparatus and containers for use with the apparatus, the apparatus including at least one dispensing nozzle and each container including, in its base region, a charging opening and a one-way valve located in the opening and providing for dispensing of a liquid into the container by the penetration of the container by the dispensing nozzle of the apparatus via the charging opening and the one-way valve and sealing of the opening following retraction of the dispensing nozzle from the container.

Each container as used within the dispensing system of the invention may be formed of a synthetic plastics material, typically a material such as polypropylene. The one-way valve of each container that is located in the charging opening thereof may be a flap-type valve, typically a flap-type valve of a silicone material. The one-way valve of each container also may form a seal around the dispensing nozzle of the dispensing apparatus when the nozzle penetrates the container via its charging opening and the one-way valve. One-way valves suitable for the above purpose are already known.

Further according to the invention, the liquid dispensing apparatus of the liquid dispensing system may include a connector arrangement for connecting the dispensing nozzle to a liquid supply container. As such, the liquid dispensing apparatus may include liquid displacement means for displacing a liquid to be dispensed via the dispensing nozzle, the liquid displacement means typically being a pump. The liquid feed to the dispensing apparatus and particularly to the dispensing nozzle thereof, alternatively, may be a gravity feed arrangement or, still alternatively, may be a pressurized feed, i.e. a feed of liquid from a pressurized storage container.

The liquid dispensing apparatus of the liquid dispensing system may include a base structure that defines at least one receiving and locating formation that has the dispensing nozzle located with respect thereto in a configuration in which a container can be positioned on the base structure within the receiving and locating formation with the dispensing nozzle penetrating the container via its charging opening and one-way valve. Clearly, the configuration of the base structure and of the nozzle associated therewith is greatly variable, being determined particularly also by the configuration of the container into which a liquid can be dispensed via the system of the invention.

The liquid dispensing apparatus of the liquid dispensing system also may include a base structure that defines a plurality of receiving and locating formations that each has a dispensing nozzle located with respect thereto in a configuration in which containers can be positioned on the base structure within the receiving and locating formations with the dispensing nozzles penetrating these containers via their charging openings and one-way valves. Each receiving and locating formation defined by the base structure of the liquid dispensing apparatus and each container may define complementary guide formations that operatively cooperate with one another for guiding positioning of a container into a receiving and locating formation in a configuration in which the dispensing nozzle associated with the receiving and locating formation thereby penetrates the container via its charging opening and one-way valve.

Further according to the invention, the dispensing apparatus may include control means for controlling the dispensing of a liquid into a container. The control means may provide for a fixed volume of liquid to be dispensed into the container or, alternatively, may include a sensing means that can sense the level of a liquid dispensed into a container and de-activate the apparatus to stop liquid being dispensed when a predetermined level of the liquid within the container is reached. Particularly for a liquid dispensing system, including a liquid dispensing apparatus that defines a plurality of receiving and locating formations that each has a dispensing nozzle located with respect thereto for dispensing a liquid into a container, the control means my be configured either to control dispensing of liquid simultaneously into each container located within a receiving and locating formation, or to control dispensing of liquid into individual containers.

The invention extends also to a liquid dispensing apparatus for use in a liquid dispensing system, in accordance with the invention, as well as to a container for use in a liquid dispensing system, in accordance with the invention.

Within the principles of the liquid dispensing system as hereinabove defined, the features of the system may be varied in various different respects, particularly also in relation to the features of the container and of the liquid dispensing apparatus, that are provided for use in the system.

BRIEF DESCRIPTION OF THE DRAWINGS

Further features of the invention are described hereafter with reference to examples of liquid dispensing systems, in accordance with the invention, which are illustrated in the accompanying diagrammatic drawings. In the drawings.

DETAILED DESCRIPTION OF THE INVENTION

Figure 1:
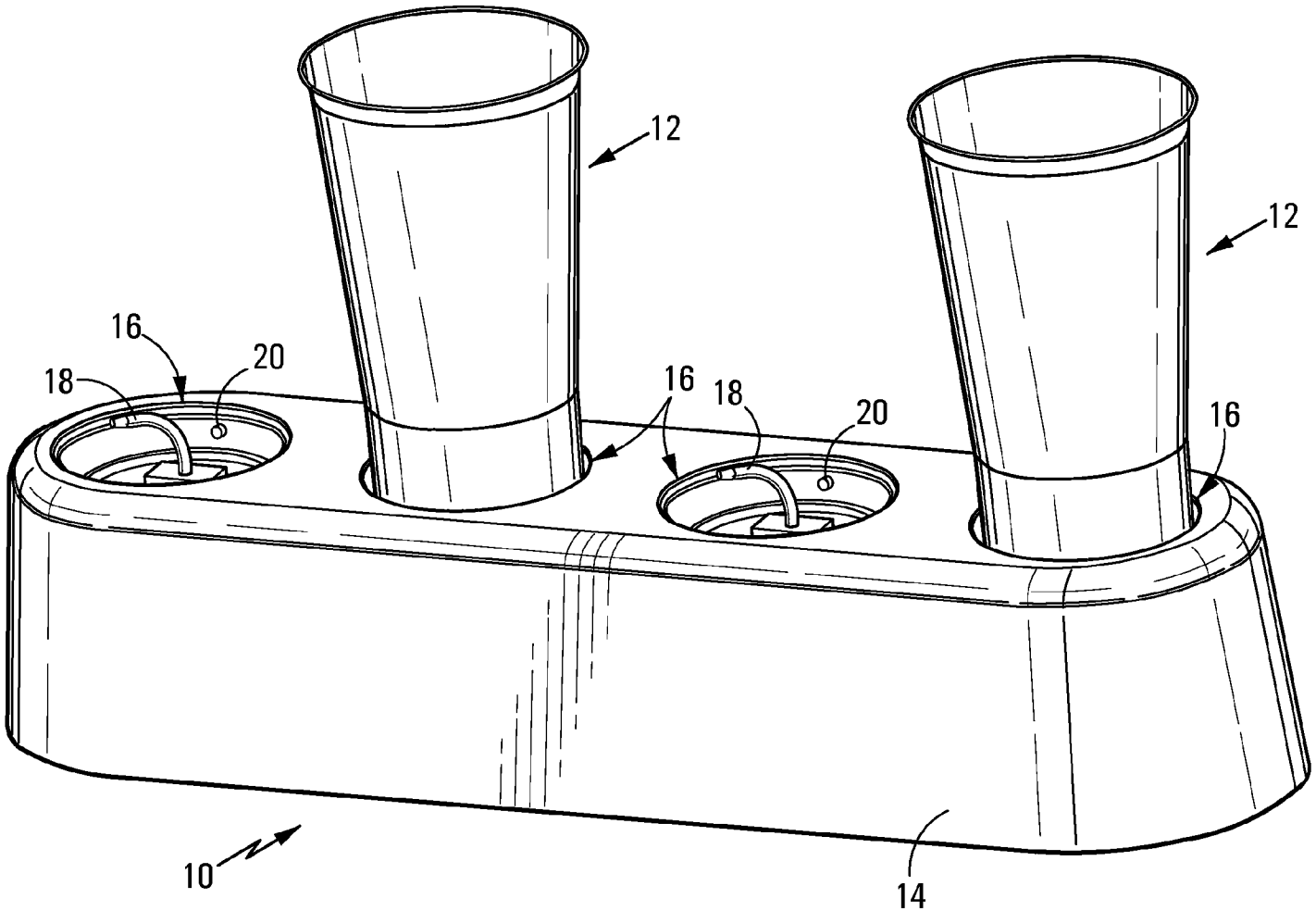
FIG. 1 shows an isometric view of a liquid dispensing apparatus and two containers for use within a first embodiment of a liquid dispensing system, in accordance with the invention.

Referring initially to FIGS. 1 to 8 of the drawings, a first embodiment of a liquid dispensing system, in accordance with the invention, includes a dispensing apparatus designated generally by the reference numeral 10 and containers designated generally by the reference numeral 12, the containers being configured as described hereafter in order to permit dispensing of, for example, a carbonated beverage, beer, or the like, from a storage container via the dispensing apparatus 10 into a container 12.

The liquid dispensing apparatus 10 includes a base structure 14 which can be positioned on or mounted on a suitable support surface, the apparatus 10 being configured particularly to permit dispensing of liquid simultaneously into four containers. It must be understood in this regard that different dispensing apparatus can be provided which will permit dispensing of liquid simultaneously into any alternative number of containers, as may be required for different practical applications.

The base structure 14 accordingly defines four receiving and locating formations 16 that are configured to receive and locate the bottom end of a container 12 therein, each formation 16 being associated with a nozzle 18 whereby a liquid can be dispensed into a container, the mode of support of a container and actual dispensing of a liquid into a container being described in more detail hereafter.

All the nozzles 18 are connected in liquid communication with a liquid storage container (not shown), i.e. a storage container containing the liquid to be dispensed, the storage container typically being located at a remote location from the dispensing apparatus 10. In order to provide for the displacement of a liquid from a storage container via a nozzle 18 into a container 12, the liquid contained in a storage container may be under pressure or, alternatively, the storage container may be located at an elevated level above the dispensing apparatus in order to provide for a gravity feed of liquid therefrom. Still alternatively, the dispensing apparatus may include a suitable liquid displacement means, e.g. a pump, which is operable to displace liquid from a liquid storage container into a container 12 via a nozzle 18 of the dispensing apparatus. This relationship between the liquid dispensing apparatus and a liquid storage container will be apparent to those skilled in the art and, as such, is not described further herein.

The dispensing apparatus 10 further includes control means (not shown) for controlling dispensing of a liquid into a container, the control means typically being electronically operable and controlling the flow of liquid through each particular nozzle through which a liquid should be dispensed into a container and also the volume of liquid to be dispensed into a container. Many different configuration control means are envisaged and may be associated with different configuration dispensing apparatus and, once again, this is not described in further detail herein.

Figure 2:
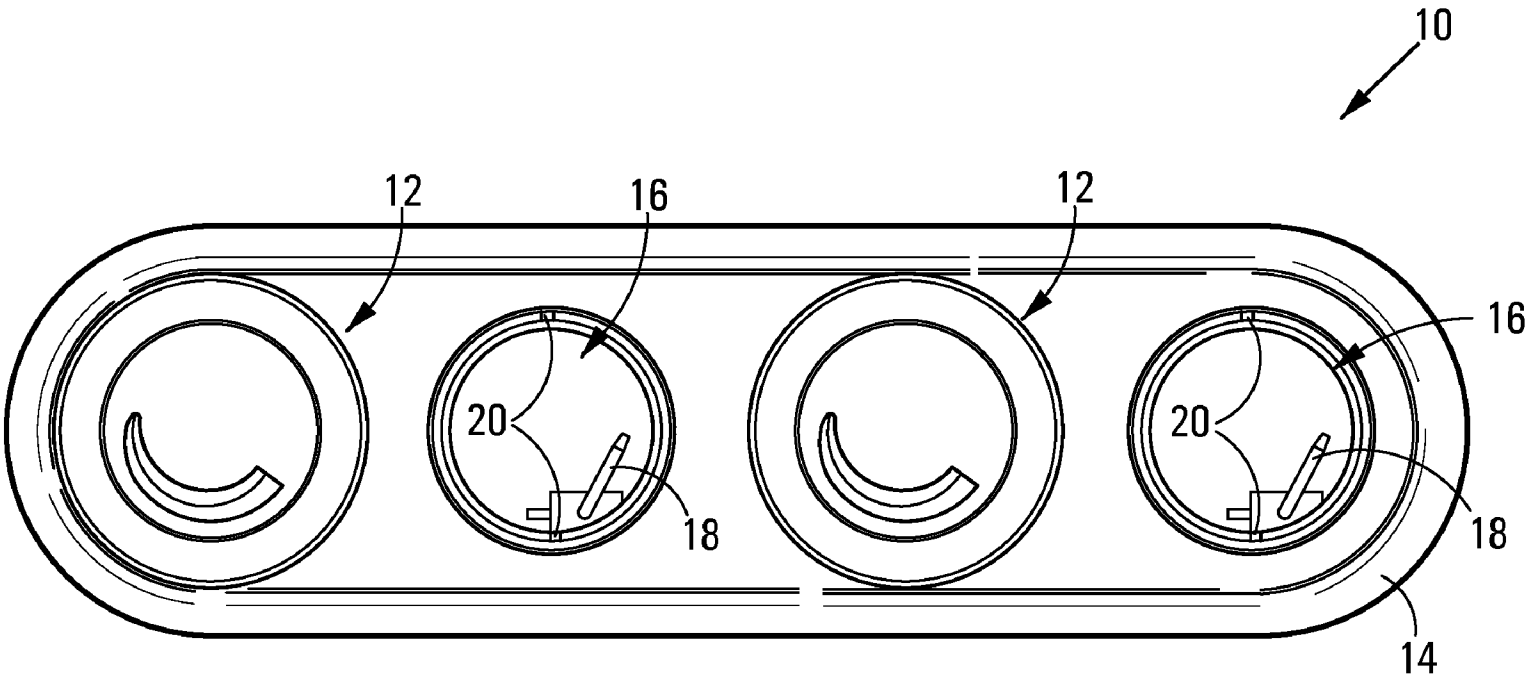
FIG. 2 shows a plan view of the liquid dispensing apparatus and containers as shown in FIG. 1.
Figure 3:
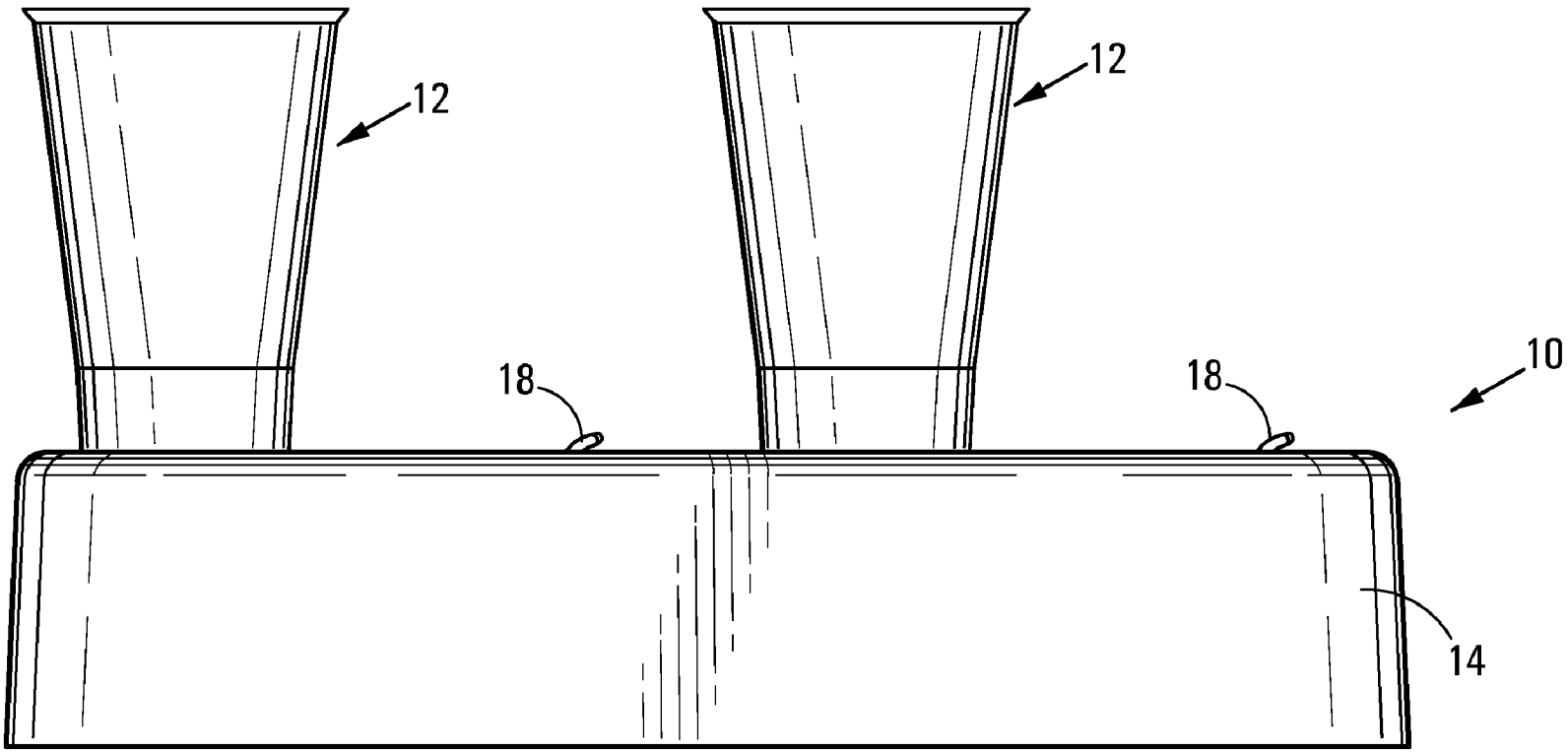
FIG. 3 shows a front view of the liquid dispensing apparatus and containers as shown in FIG. 1.
Figure 4:
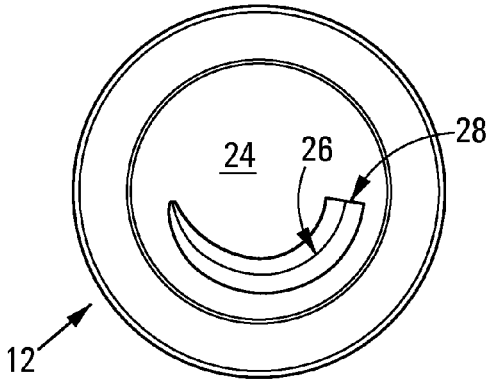
FIG. 4 shows a top view of one of the containers as shown in FIG. 1.
Figure 5:
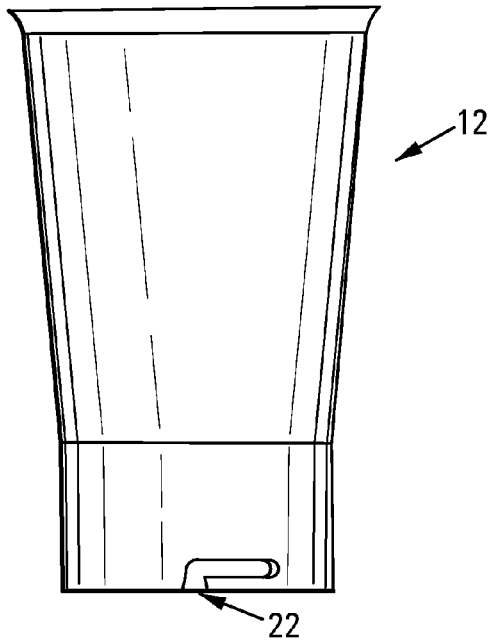
FIG. 5 shows a side view of the container of FIG. 4.
Figure 6:
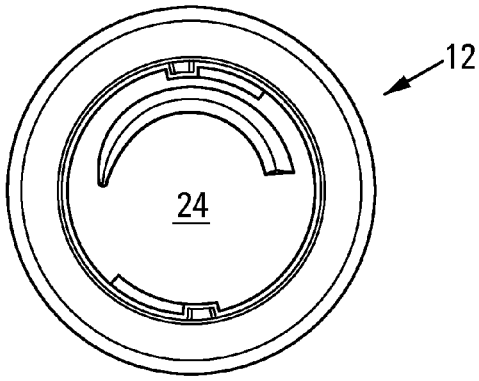
FIG. 6 shows a bottom view of the container of FIG. 4.
Figure 7:
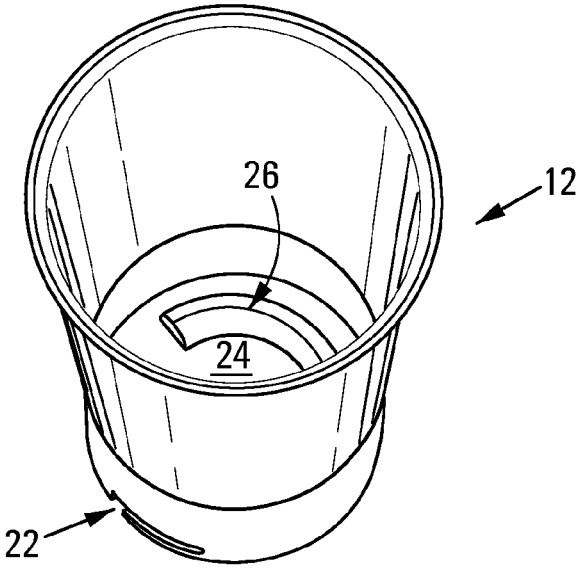
FIG. 7 shows a top perspective view of the container of FIG. 4.
Figure 8:
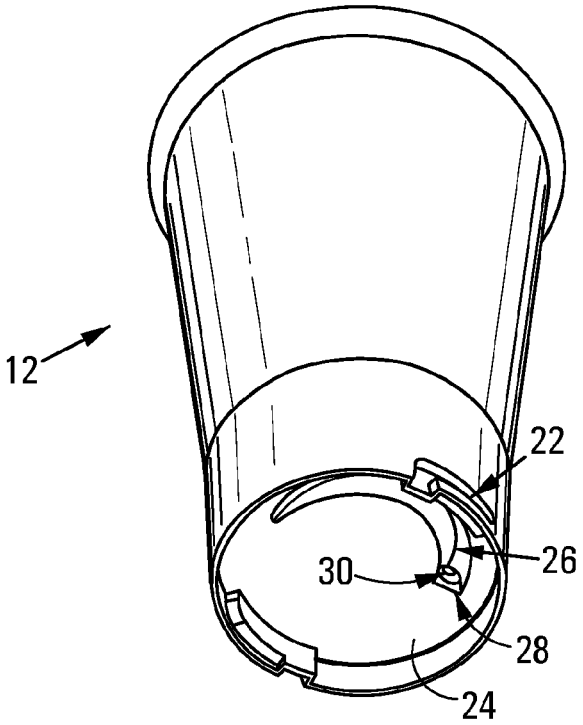
FIG. 8 shows a bottom perspective view of the container of FIG. 4.
Figure 9:
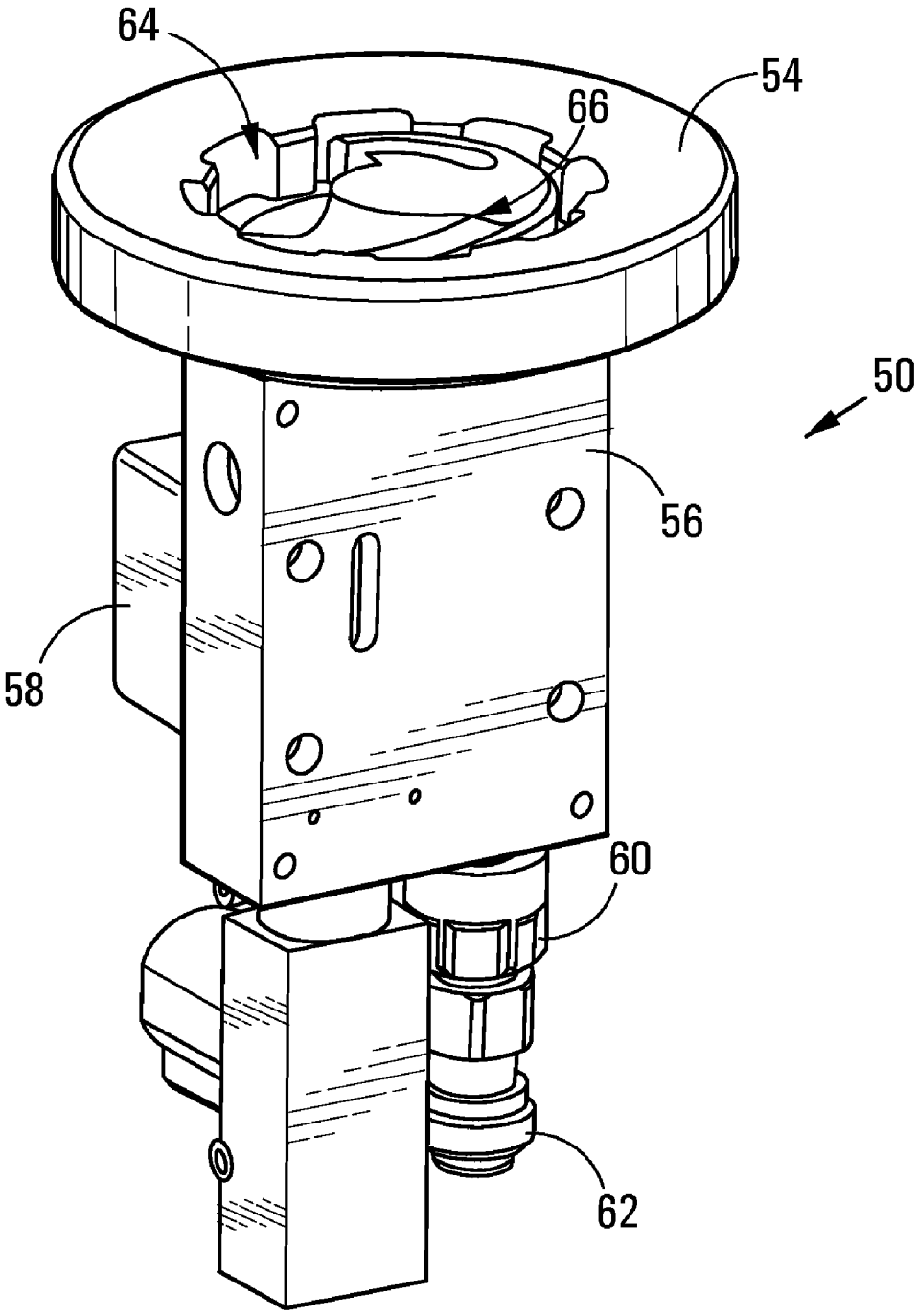
FIG. 9 shows an isometric view of a part of a liquid dispensing apparatus of a second embodiment of a liquid dispensing system, in accordance with the invention.

As is illustrated clearly in FIGS. 1 to 3 of the drawings, each receiving and locating formation 16 comprises a recess formation having diametrically opposite locating pins 20 projecting towards one another as shown, the pins 20 being configured to cooperate with formations 22 defined within the base region of a container, operatively beneath the base wall of the container, for locating the container within a formation 16. The pins 20 and the formations 22, as shown, are configured to cooperate in a bayonet-type fashion to provide for the required location of a container 12 in a formation 16 in order to permit dispensing of a liquid into the container. The base wall 24 of each container 12 has a charging opening defined by a passage formation 26 that leads into the interior of the container above the base wall 24 from an opening 28 defined within the base wall 24, the passage formation having a one-way valve 30 (not clearly illustrated) located therein. The one-way valve 30 is a known type silicone flap-type valve that permits the insertion of a nozzle 18 into the passage formation beyond the valve and, as such, dispensing of a liquid into a container 12 via the nozzle, when so located. The location of a nozzle 18 into a passage formation 26 will occur as part of the locating process of a container 12 within a formation 16, which involves also the engagement of the pins 20 and formations 22 as described. The reverse operation will be effected after a container has been filled with a liquid, to permit removal of a container from the dispensing apparatus. Upon the withdrawal of a nozzle 18 from a passage formation 26, the one-way valve 30 will effectively block the passage formation, thus sealing the base wall of the container and ensuring the required retention of liquid within the container. While a nozzle 18 penetrates the one-way valve 30, it will form a seal around then nozzle.

Once again and as above suggested, the exact filling operation of containers 12 is greatly variable while still incorporating the use of apparatus and containers including the essential principles of the invention as hereinabove described and which provides for "bottom filling" of containers as opposed to conventional "top filling" of containers via nozzles located above the open top ends of containers.

It is clear that the overall construction of the liquid dispensing apparatus and of containers for use with this apparatus as part of a liquid dispensing system, in accordance with the invention, can be varied in various different respects, while still accommodating the essential principles of the system which provide essentially for "bottom filling" of containers which, particularly in relation to carbonated beverages, beer, and the like, can be effected significantly quicker than "top filling" of containers, particularly because the formation of a foam head on the liquid filled into a container need not be a major consideration and does not affect the rate of filling a container.

In relation to different forms of apparatus, the apparatus can include an integrated dispensing unit which incorporates a dispensing nozzle, a receiving and location formation for a container, control means for controlling the volume of liquid dispensed into a container, which typically includes a flow meter, and a connector arrangement for connecting the dispensing nozzle thereof to a liquid supply line. Such a dispensing unit can then be associated with any suitable base structure or means for its support in a configuration in which it can be used for dispensing a liquid. Typically, a plurality of dispensing units as envisaged can be mounted into a base structure which can be supported on a support surface, so that with all the connector arrangements of the units connected to a liquid supply line, a liquid dispensing apparatus is provided which is essentially the equivalent of the apparatus 10.

Referring now also to FIGS. 9 to 15 of the drawings, a dispensing unit as above envisaged as part of a liquid dispensing apparatus is designated generally by the reference numeral 50, whereas a container for use with the unit is designated generally by the reference numeral 52. The dispensing unit 50 includes a locating ring 54, an on/off valve assembly 56, control circuitry carried within a housing 58, an electronic flow meter 60 and a connector arrangement 62, all the above parts being integrated with one another in the configuration illustrated for forming the unit 50.

Figure 10:
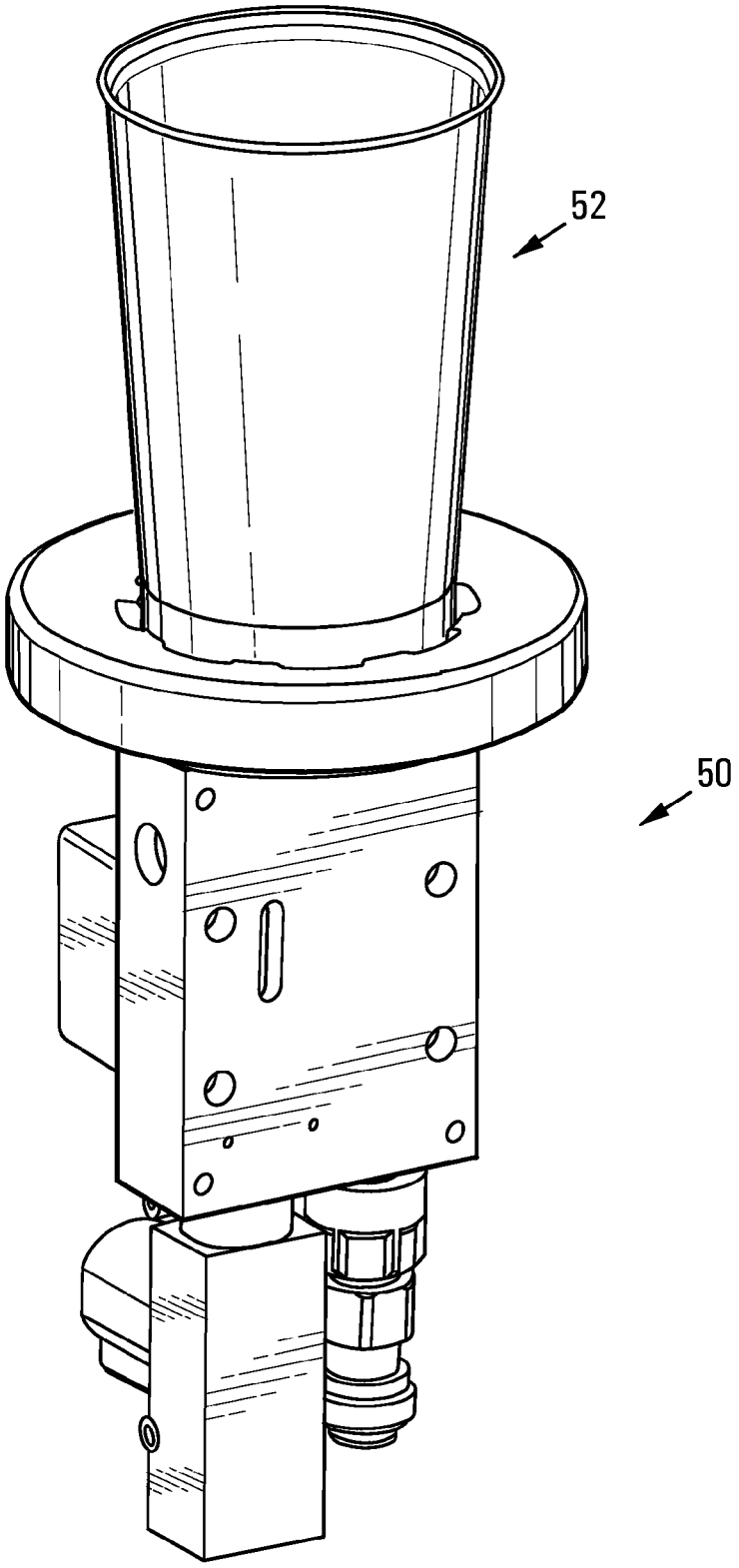
FIG. 10 shows an isometric view of the part of the liquid dispensing apparatus of FIG. 1, having a container, that forms a part of the second embodiment of the liquid dispensing system of the invention, located thereon.
Figure 11:
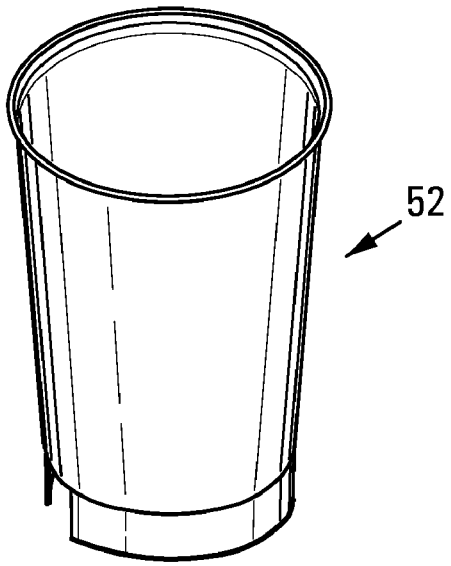
FIG. 11 shows a top perspective view of the container as shown in FIG. 10.
Figure 12:
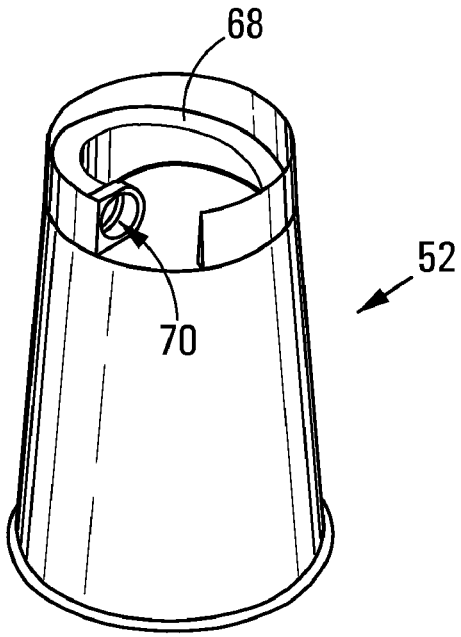
FIG. 12 shows a bottom perspective view of the container of FIG. 10.
Figure 13:
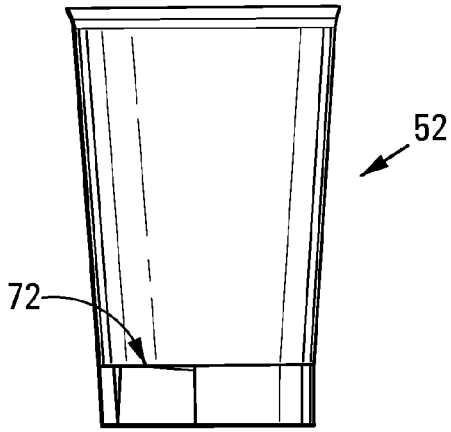
FIG. 13 shows a side view of the container of FIG. 10.
Figure 14:
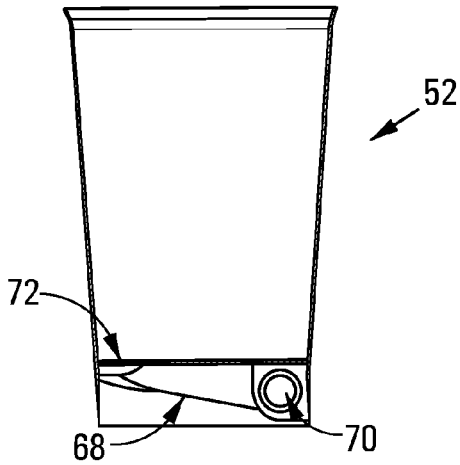
FIG. 14 shows a cross-sectional side view of the container of FIG. 10.
Figure 15:
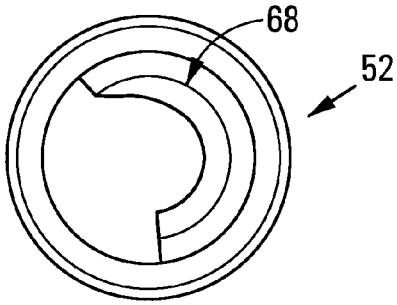
FIG. 15 shows a top plan view of the container of FIG. 10.

The locating ring 54 defines a receiving and locating formation 64 within which the base region of the container 52 is receivable as shown in FIG. 10, particularly in a configuration in which a dispensing nozzle (not shown but being essentially the equivalent of the nozzle 18 of the dispensing apparatus 10 as above described) can penetrate into the interior of the container 52 via a charging opening and a one-way valve, as is already herein envisaged. The receiving and locating formation 64 defines guide formations therein, designated generally by the numeral 66, which are configured to cooperate with complementary formations, designated generally by the numeral 68, in the base region of the container 52 for guiding the displacement of the dispensing nozzle with respect to the container, particularly through rotation of the container while bearing downwardly thereon, which will provide for the dispensing nozzle to enter a passage 70 and pass through the passage into the container via a one-way valve 72 (not shown in detail). It will thus be understood that with the connector arrangement connected to a liquid supply line, through the operation of the control circuitry, a liquid will be dispensed into the container 52, particularly a predetermined controlled volume of this liquid which will provide for the liquid container to be effectively filled thereby.

The container 52 clearly is configured specifically to cooperate with the dispensing unit 50, particularly in relation to its location within the receiving and locating formation 64, which provides for the dispensing nozzle of the unit to penetrate into the container to permit filling thereof. By the removal of the container from the unit 50, by reverse manipulation, the dispensing nozzle will withdraw from the container while the flap valve will be acted upon by the liquid contained in the container for blocking the charging opening leading into the container, thus ensuring that liquid cannot leak from the container. The overall construction of the container 52 is thus essentially equivalent to that of the container 12 described above, except insofar as its base region is specifically configured to cooperate with the dispensing unit 50. This is thus not described in any further detail herein.

It will be appreciated that dispensing units can be conveniently mounted into any suitable base structure in a configuration in which the locating rings thereof are disposed to facilitate the base region of containers to be received and located therein, it being envisaged that base structures can be configured to accommodate various different numbers of dispensing units, as will be determined by dispensing requirements. When combined with a base structure, as referred to above, a liquid dispensing apparatus is provided which is essentially the equivalent of the apparatus 10 as above described.

The exact configuration of the dispensing unit 50 and any base structure associated therewith can be varied in many different respects, while the mode of cooperation between the unit and containers to be used therewith also can be varied. The invention extends to all such variations and generally to all such variations of the overall dispensing system as herein envisaged and which includes both a liquid dispensing apparatus and containers specifically configured to cooperate therewith.

What is claimed is:

1. A liquid dispensing system comprising:

a liquid dispensing apparatus having at least one dispensing nozzle; and containers for use with the liquid dispensing apparatus;

wherein each container has a base region formed with a sealable charging opening having a one-way valve located in the charging opening and providing for dispensing of a liquid into the container by the penetration of the container by the dispensing nozzle of the apparatus via the charging opening;

wherein, when the container is in an upright position, the base region of the container comprises a substantially horizontal base and a first wall extending upwardly from the base and defining an open cup and a second wall extending downwardly from the base and defining a substantially hollow foot below the base;

wherein the charging opening is disposed in a substantially vertical plane when the container is in an upright position;

wherein the at least one dispensing nozzle of the dispensing apparatus is disposed in a substantially horizontal plane and adapted to penetrate the charging opening along the substantially horizontal plane upon engagement of the container by the dispensing nozzle in use; and wherein the one-way valve of the container is adapted to form a seal about the at least one dispensing nozzle of the dispensing apparatus when the dispensing nozzle penetrates the container through the charging opening and one-way valve and to seal the charging opening following retraction of the dispensing nozzle from the container.

2. A liquid dispensing system as claimed in claim 1, in which the liquid dispensing apparatus comprises a base structure having a plurality of receiving and locating formations, wherein each of the plurality of receiving and locating formations has an associated dispensing nozzle located with respect thereto in a configuration in which each of the containers can be positioned on the base structure within an associated one of the plurality of receiving and locating formations with each dispensing nozzle penetrating an associated container via the charging opening and one-way valve of the container.

3. A liquid dispensing system as claimed in claim 2, in which each receiving and locating formation defined by the base structure and each container define complementary guide formations that operatively cooperate with one another for guiding positioning of a container into an associated receiving and locating formation in a configuration in which the dispensing nozzle associated with the receiving and locating formation thereby penetrates the container via the charging opening and one-way valve of the container.

4. A liquid dispensing system as claimed in claim 1, in which the dispensing apparatus comprises control means for controlling the dispensing of a liquid into a container.

5. A liquid dispensing system as claimed in claim 4, in which the control means provides for a fixed volume of liquid to be dispensed into a container.

6. A liquid dispensing system as claimed in claim 1, in which the charging opening comprises a passage formation extending from the one-way valve to an opening in the base, the passage formation configured to allow liquid to pass from the dispensing nozzle of the liquid dispensing apparatus into the interior of the container.

7. A liquid dispensing system as claimed in claim 6, in which the passage formation extends along a portion of the periphery of the base, whereby the passage formation is configured to cause liquid to rotate within the container when liquid is dispensed into the charging opening from the liquid dispensing apparatus.

8. A liquid dispensing apparatus for use in a liquid dispensing system comprising containers for use with the liquid dispensing apparatus, the liquid dispensing apparatus comprising:

at least one dispensing nozzle disposed in a substantially horizontal plane during operation of the liquid dispensing apparatus, the at least one dispensing nozzle being adapted to penetrate a sealable charging opening and a one-way valve located in the charging opening of a container, the charging opening being disposed in a substantially vertical plane upon engagement of the container by the at least one dispensing nozzle and providing for dispensing of a liquid into the container by the penetration of the container by the dispensing nozzle.

9. A container for use in a liquid dispensing system comprising a liquid dispensing apparatus having at least one dispensing nozzle disposed in a substantially horizontal plane during operation of the liquid dispensing apparatus, the container comprising:

a base region formed with a sealable charging opening having a one-way valve located in the charging opening and providing for dispensing of a liquid into the container by penetration of the container by the dispensing nozzle of the dispensing apparatus via the charging opening;

wherein, when the container is in an upright position, the base region of the container comprises a substantially horizontal base and a first wall extending upwardly from the base and defining an open cup and a second wall extending downwardly from the base and defining a substantially hollow foot below the base;

wherein the charging opening is disposed in a substantially vertical plane within the hollow foot when the container is upright and adapted to be penetrated by the at least one dispensing nozzle along the substantially horizontal plane upon engagement of the container by the dispensing nozzle in use; and wherein the one-way valve of the container is adapted to form a seal about the at least one dispensing nozzle of the dispensing apparatus when the dispensing nozzle penetrates the container through the charging opening and one-way valve and to seal the charging opening following retraction of the dispensing nozzle from the container.

10. A container as claimed in claim 9, in which the charging opening comprises a passage formation extending from the one-way valve to an opening in the base, the passage formation configured to allow liquid to pass from the dispensing nozzle of the liquid dispensing apparatus into the interior of the container.

11. A container as claimed in claim 10, in which the passage formation extends along a portion of the periphery of the base, whereby the passage formation is configured to cause liquid to rotate within the container when liquid is dispensed into the charging opening from the liquid dispensing apparatus.

* * * * *